United States Patent [19]

Donaldson et al.

[11] 4,067,687

[45] Jan. 10, 1978

[54] PHOSPHORUS, NITROGEN, BROMINE CONTAINING POLYMERS AND PROCESS FOR PRODUCING FLAME RETARDANT TEXTILES

[75] Inventors: Darrell J. Donaldson; George L. Drake, Jr., both of Metairie; John V. Beninate, Gretna; Wilson A. Reeves, Metairie; Donald J. Daigle, New Orleans, all of La.

[73] Assignee: The United States of America as represented by the Secretary of Agriculture, Washington, D.C.

[21] Appl. No.: 652,277

[22] Filed: Jan. 23, 1976

Related U.S. Application Data

[60] Division of Ser. No. 499,810, Aug. 22, 1974, which is a continuation-in-part of Ser. No. 265,862, June 23, 1972, Pat. No. 3,915,915, which is a continuation of Ser. No. 141,357, May 7, 1971, abandoned.

[51] Int. Cl.[2] ..... D06M 1/00

[52] U.S. Cl. ..... 8/116 P; 106/15 FP; 252/8.1; 428/921

[58] Field of Search ..... 8/116 P; 260/29.4 UA; 252/8.1; 106/15 FP; 428/921

[56] References Cited

U.S. PATENT DOCUMENTS

| | | | |
|---|---|---|---|
| 3,698,854 | 10/1972 | Donaldson et al. | 8/116 |
| 3,883,463 | 5/1975 | Jin et al. | 260/29.6 MN |

*Primary Examiner*—William E. Schulz
*Attorney, Agent, or Firm*—M. Howard Silverstein; David G. McConnell; Salvador J. Cangemi

[57] ABSTRACT

Textile treating compositions containing the elements phosphorus, nitrogen, and bromine and the processes for imparting flame resistance to organic fibrous materials have been prepared. This is accomplished by impregnating the textile treating compositions consisting of (1) tris(hydroxymethyl)phosphine mixed with nitrogenous compounds containing at least two members of the group hydrogen and methylol radicals ($—CH_2OH$) attached to trivalent nitrogen atoms, or (2) soluble methylol phosphine adducts which contain one or more methylol phosphine radicals ($P—CH_2OH$) prepared by reacting tris(hydroxymethyl)phosphine with an amide or amine which contains one or more hydrogens attached to a trivalent nitrogen with an organic bromine containing material with at least 10% bromine in the form of bromine atoms attached to carbon atoms, in proportions selected so that generally the phosphorus contained in structures of the group $(—CH_2)_3P$ amount to a small portion of the total weight of the mixture, and heating to cause insolubilization in or on the fibrous structure.

7 Claims, No Drawings

PHOSPHORUS, NITROGEN, BROMINE CONTAINING POLYMERS AND PROCESS FOR PRODUCING FLAME RETARDANT TEXTILES

This is a division of application Ser. No. 499,810, filed Aug. 22, 1974, which is a continuation-in-part of Ser. No. 265,862, filed June 23, 1972, now U.S. Pat. No. 3,915,915, issued Oct. 28, 1975, which in turn was a continuation of Ser. No. 141,357, filed May 7, 1971, now abandoned.

This invention relates to reducing the flammability of organic fibrous textiles. More particularly, the invention provides textile treating compositions adapted to incorporate the elements phosphorus, nitrogen, and bromine into organic fibrous textiles in a manner and amount in which the elements reduce the flammability of the organic fibrous material.

Copending application, Ser. No. 141,355, by Daigle, Drake, Pepperman, and Reeves filed May 7, 1971, relates to the production of polymers through the reaction of tris(hydroxymethyl)phosphine with nitrogenous compounds containing at least two members of the group hydrogen and methylol radicals $-CH_2OH$ attached to trivalent nitrogen atoms either in the presence of absence of formaldehyde.

Copending application, Ser. No. 141,362, by Reeves, Donaldson, Daigle, Drake, and Beninate, filed May 7, 1971, relates to the production of soluble methylol phosphine adducts which contain one or more methylol phosphine radicals ($P—CH_2OH$) prepared by reacting tris(hydroxymethyl)phosphine with an amide or amine which contains one or more hydrogens attached to a trivalent nitrogen. These soluble adducts were used to prepare thermosetting flame resistant polymers by reaction with nitrogenous compounds which contain two or more hydrogens and methylol groups attached to trivalent nitrogen.

These nitrogen containing methylol phosphorus polymers and those above which are hereinafter referred to as "nitrilo" methylol-phosphorus polymers or resins, are particularly useful as textile flammability retardants.

While the nitrilo methylol-phosphorus polymers are particularly good textile flammability reducing agents, the production of such an agent which imparts the maximum reduction in textile flammability per part of resinous impregnant is one of the goals being sought in the field of imparting flame resistance to textile materials.

A primary object of the present invention is to provide improved nitrilo methylol-phosphorus textile flammability reducing compositions in which the desirable properties characteristic of the nitrilo methylol-phosphorus compositions (properties such as causing only a slight reduction in hand, feel, tear strength, and the like desirable textile properties) are retained and augmented by the incorporation of certain bromine containing materials.

We have now discovered that when nitrilo methylol-phosphorus polymers having a nitrogen and phosphorus content within certain ranges of both amount and nitrogen-to-phosphorus ratios are mixed with a certain proportion of non-volatile compositions containing firmly attached bromine, the resulting compositions exhibit a flame reducing efficiency which is materially greater than that of compositions which differ only in the absence of the bromine containing compositions.

In general, in accordance with the present invention, a homogeneous polymeric mixture is formed by mixing at least one nitrilo methylol-phosphorus polymer and at least one organic substance containing at least 10% of bromine in the form of bromine atoms attached to carbon atoms in proportions selected so that ratio of phosphorus adduct to brominated substance is about from 1:0.6 to about 1:8.3.

Throughout the specification and claims, the term "parts" and "percent" are used only to refer to parts or percent by weight.

The nitrilo methylol-phosphorus polymers can be formed in the polymeric mixture, for example, by mixing the bromine containing compound with resin forming reactants of the nitrilo methylol-phosphorus polymer and converting the reactants to a polymer in situ.

The bromine containing polymeric mixtures provided by this invention can be produced in the form of liquid or solid compositions. They are homogeneous mixtures characterized by a particularly high resistance to burning and the property of imparting high degree of resistance to burning to other materials. These mixtures are generally useful wherever mixtures predominating in cross-linked polymers are useful. Illustrative examples include their use in the production of molded synthetic plastic articles such as buttons, containers, electrical insulators and the like; synthetic coatings such as paints, varnishes, and the like; adhesives; and impregnating agents for textiles, ropes, paper and the like.

These bromine containing polymeric mixtures are particularly suited for use in the impregnation of organic textiles to reduce their flammability. These mixtures can be used in the treatment of vegetable textile materials such as cotton, flax, linen, ramie, and the like, chemically modified vegetable textile materials such as cyanoethylated, carboxymethylated, aminoethylated cottons and the like; regenerated cellulosic textiles such as the viscose rayons; or proteinaceous textiles such as silk, wool, and mixtures of these with noncellulosic fibers which can be impregnated with a liquid and dried and cured. Where textile structures are being treated in accordance with this invention, the structure may be composed of a mixture of various fibers such as those mentioned above mixed with nylon or polyester fibers. The polymers produced in or on fibrous textile structures are more effective in reducing the combustibility of these products which consists only of cellulosic fibers. When noncellulosic fibers are present, best results are obtained when the structure contains 50% or more cellulosic fibers except when the noncellulosic fiber is itself flame resistant.

The textile materials can be treated in the form of slivers, yarns, threads, or fabrics. The polymers contained in the mixtures can be separately formed or can be produced in situ in the textile by a reaction of materials with which the textile is impregnated. The mixtures can be used as the only material with which the textile is impregnated or used in conjunction with other textile flameproofing, creaseproofing, wrinkleproofing and like textile treating agents; or in conjunction with textile lubricants, water repellents, and the like textile treating agents.

BROMINE CONTAINING COMPOUNDS APPLICABLE

The bromine containing compositions which can be mixed with the nitrilo methylol-phosphorus polymers are substances containing at least about 10% of bromine in the form of bromine atoms attached to carbon atoms, and can contain the elements phosphorus, chlorine and/or nitrogen.

I. One preferred class of such bromine containing compositions comprises the polybromo alcohol neutral esters of phosphonitrilic halides. Illustrative examples of such esters include the 2,3-dibromopropyl esters of the phosphonitrilic chlorides, and the like esters, disclosed in U.S. Pat. No. 2,681,295.

II. Another preferred class of such bromine containing compositions comprise those of the polymeric addition products of (a) $C_{1-2}$ polyhalohydrocarbons containing at least two atoms of the group bromine and chlorine attached to the same carbon atom and (b) terminally unsaturated alkenol esters of phosphorus nitrilic halides which are addition products containing at least about 10% bromine. Such addition products are capable of being produced by a free radical initiated reaction between the components of a mixture of reactants consisting of at least one of the groups, (a) a polymerizable terminally unsaturated alkenol ester of phosphonitrilic halide and (b) a polybromohydrocarbon of the group

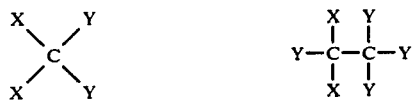

in which X represents bromine and Y represents bromine, chlorine, or hydrogen; in which mixture the reactants and the proportion in which they are mixed are selected so that the mixture contains at least about 10% of bromine in the form of bromine atoms attached to carbon atoms; with said reaction being conducted until the resulting polymeric addition product contains at least about 10% bromine. Suitable processes of producing typical members of such polymeric addition products are described in more detail in U.S. Pat. No. 2,825,718.

Terminally unsaturated alkenol esters of phosphorus nitrilic halides which are particularly useful in producing such polymeric addition products include the allyl esters of the tri- and tetrameric phosphonitrilic chlorides, bromides, and the like. Terminally unsaturated $C_{3-5}$ alkenol esters of the lower polymeric phosphonitrilic chlorides are particularly preferred. Polybromohydrocarbons which are particularly useful in producing such polymeric addition products include bromoform, carbon tetrabromide, and the like. Polybromomethanes are preferred polybromohydrocarbons.

III. Another preferred class of bromine containing materials, comprises those of the analogous polymeric addition products of terminally unsaturated N-alkenylated melamines which contain at least about 10% bromine in the form of bromine atoms attached to carbon atoms and which are free of methylol reaction groups. Such polymeric addition products are capable of being produced by a free radical initiated addition reaction between the components of a mixture of reactants consisting of at least one member of each of the first two groups, (a) a polymerizable terminally unsaturated alkenylated melamine of the formula

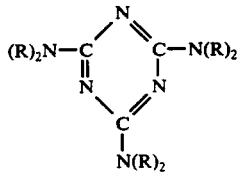

in which R represents a lower alkyl radical or a terminally unsaturated alkenyl radical, and at least two of the latter radicals are present in each compound, (b) a polybromo hydrocarbon of the class

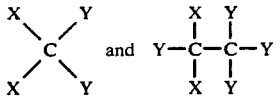

as defined above, and (c) from 0 to 20% of the combined weight of (a) and (b) of a lower aliphatic aldehyde; in which mixture the reactants and the proportion in which they are mixed are selected so that the mixture contains at least about 10% of bromine in the form of bromine atoms attached to carbon atoms; with said reaction being conducted until the resulting polymeric addition product contains at least about 10% bromine. Terminally unsaturated N-alkenylated melamines, which can be used in the production of such polymeric addition products include N,N-diallyl melamine, N,N-diallyl methylolmelamine, N,N'-tetraallylmelamine and the like. The terminally unsaturated N-alkenylated melamines containing about from 2 to 6 $C_{3-5}$ alkenyl radicals are preferred, the allylic melamines being particularly preferred. Polybromo hydrocarbons which can be used in producing such polymeric addition products include bromoform, carbon tetrabromide, and the like. The polybromomethanes are preferred polybromohydrocarbons.

IV. Another preferred class of bromine containing compositions comprises the polymeric addition products of polybromo hydrocarbons and polymerizable aliphatic acrylamides which addition products contain at least about 10% of bromine in the form of bromine atoms attached to carbon atoms. Such addition products are capable of being produced by a free radical initiated addition reaction between the components of a mixture of reactants consisting of at least one member of each of the first two groups, (a) polymerizable compounds of the formula

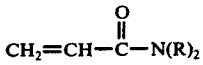

in which R represents a lower alkyl radical or

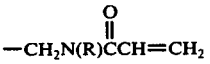

(b) a polybromohydrocarbon of the class

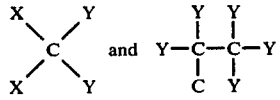

as defined above and (c) from 0 to 20% of the combined weight of (a) and (b) of a lower aliphatic aldehyde; in which mixture the reactants and the proportion in which they are mixed are selected so that the mixture contains at least about 10% of bromine in the form of bromine atoms attached to carbon atoms; with said reaction being conducted until the resulting polymeric addition product contains at least about 10% bromine. Aliphatic acrylamides which can be used in the production of such polymeric addition products include N,N'-methylenebis-acrylamide, and the like. Acrylamide and methylenebis-acrylamides are particularly preferred. Polybromohydrocarbons which can be used in the production of such polymeric addition products include bromoform, carbon tetrabromide, and the like. The polybromomethanes are preferred polybromohydrocarbons.

Suitable processes of producing typical members of the addition products of both the N-alkenylated melamines and the aliphatic acrylamides with polybromohydrocarbons are described in greater detail in U.S. Pat. No. 2,861,901.

V. Another preferred class of bromine containing materials comprises the polymeric addition products of polybromohydrocarbone and polymerizable trialkenyl phosphates which addition products contain at least about 10% of bromine in the form of bromine atoms attached to carbon atoms. Such polymeric addition products are capable of being produced by a free radical initiated addition reaction between the components of a mixture of reactants consisting of at least one member of each of the groups, (a) polymerizable alkenyl phosphates of the formula

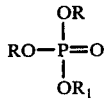

in which R represents an alkyl radical or a terminally unsaturated alkenyl radical and $R_1$ represents a terminally unsaturated alkenyl radical, and (b) a polybromohydrocarbon of the class

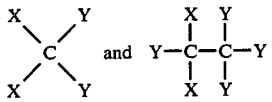

as defined above; in which mixture the reactants and the proportions in which they are mixed are selected so that the mixture contains at least about 10% of bromine in the form of bromine atoms attached to carbon atoms, with said reaction being conducted until the resulting polymeric addition product contains at least about 10% bromine. Trialkenyl phosphates which can be used in the production of polymeric addition include triallyl phosphate, trimethylallyl phosphate, and the like. Terminally unsaturated $C_{3-5}$ trialkenyl phosphates are preferred, the allylic phosphates are being particularly preferred. Polybromohydrocarbons which can be used in the production of such polymeric addition products include bromoform, carbon tetrabromide, dibromodichloromethane and the like. The polybromomethanes are particularly preferred. Suitable processes of producing typical members of such polymeric addition products are described in greater detail in U.S. Pat. Nos. 2,778,747, 2,686,768 and 2,686,769.

VI. Other suitable bromine containing materials include these brominated polymers of triallyl phosphate and the like bromine containing polymers of unsaturated phosphates described in U.S. Pat. Nos. 2,660,524 and 2,660,543, and the like materials which contain at least about 10% of bromine in the form of bromine atoms attached to carbon atoms.

VII. Other suitable bromine containing materials include polybromohydrocarbon such as polyvinylbromide and the like materials which contain at least about 10% of bromine in the form of bromine atoms attached to carbon atoms.

Free radical reaction initiators which can be used in the above described free radical initiated reactions between various polybromohydrocarbon and various unsaturated compounds include substantially any compounds which are susceptible to being decomposed to yield free radicals under the influence of heat, light, or fast elemental particles formed in the course of the reaction. Illustrative examples of such free radical reaction initiators include peroxides such as dibenzoyl peroxide, ditertiary-butyl peroxide, hydrogen peroxide, alkali metal persulfates, benzoyl hydroperoxide, cumene hydroperoxide, and the like; azo compounds such as 2,2'-bisazoisobutyronitrile; and ketones in conjunction with actinic light and the like reaction initiators. The peroxides, and, where the reaction is conducted in an aqueous emulsion reaction medium, the water soluble peroxides, are particularly preferred.

TEXTILE APPLICATION

Where the polymeric mixtures provided by this invention are employed as textile flammability reducing agents, the textile can be impregnated with the bromine containing composition and then reimpregnated with the nitrilo methylol-phosphorus polymer or vice versa, or the bromine containing composition and the nitrilo methylolphosphorus polymer can incorporated into an organic or aqueous liquid, in the form of a solution, dispersion, emulsion, or suspension, and simultaneously applied to the textile by impregnating the textile with said liquid. The latter method comprises a preferred method of applying the polymer mixtures to textiles.

In general, whether the nitrilo methylol-phosphorus polymer and the bromine containing material are mixed before or after application to a textile, it is preferable to apply the nitrilo methylol-phosphorus polymer to the textile in the form of either a further polymerizable polymer or a mixture of nitrilo methylol-phosphorus resin forming reactants and insolubilizing the nitrilo methylol-phosphorus polymer in situ in the textile. Textiles impregnated with a liquid containing the nitrilo methylol-phosphorus resin forming materials are preferably dried by heating them to about from 60° to 125° C for about from 2 to 15 minutes, with the lower temperature being used with the longer time, to evaporate volatile materials. The insolubilization of the nitrilo methylol-phosphorus resin forming materials can be accomplished thermally by heating the textiles containing them to a temperature of about from 125° to 170° C for about from 2 to 15 minutes, with the lower temperature being used with the longer time.

The application of the polymeric mixtures provided by this invention to textiles can be accomplished by means of the usual procedures and apparatus for impregnating textiles with resinous materials. These mixtures can further be mixed with the usual textile softening, lustering, lubricating and the like textile treating agents.

NITRILO-PHOSPHORUS CONTAINING COMPOUNDS APPLICABLE

The phosphorus compound which can be used in the production of nitrilophosphorus adducts for use in this invention is tris(hydroxymethyl)phosphine with nitrogen compounds containing at least two members of the group hydrogen atoms and methylol radicals (—$CH_2OH$) attached to trivalent nitrogen atoms in the presence of absence of formaldehyde. The soluble methylol phosphine adducts for use in this invention are prepared by reacting tris(hydroxymethyl)phosphine either in the presence or absence of free formaldehyde with an essentially monomeric amide or amine in a suitable solvent. In order to make the soluble useful adduct there must be an excess of methylol-phosphorus radicals (—$PCH_2OH$) in the adduct. The tris(hydroxymethyl)phosphine is trifunctional, the functionality of the amines or amides is determined by the number of hydrogen or methylol radicals attached to trivalent nitrogen in the compound to be reacted with tris(hydroxymethyl)phosphine. The adduct contains unreacted methylol phosphorus radicals. The adducts are essentially materials which contain the structure of the group consisting of: $(HOCH_2)_mP—(CH_2—N<)_n$ where $m$ and $n$ are integers of 1 or 2 and the sum of $m + n$ is 3.

The following examples are illustrative of certain details of the present invention.

Example I

Twill fabrics were padded with solutions containing both a THP-Cyanamide (1:1) adduct solution prepared by allowing a mixture of 62 parts THP, 42 parts 50% Cyanamide and 90 parts of water to stand at room temperature for 1 hour and various brominated compounds. The fabrics were dried at 85° C for 3 minutes and cured at 155° C for 3 minutes. All of the treated fabrics exhibited good hand and strength and formed a black carbonaceous char when exposed to flame, indicating the presence of phosphorus.

| Solution Used | Type Fabric | % Add-on | Match Test Angle | Color |
|---|---|---|---|---|
| A | Cotton | 15.9 | 110 | Sl. Brown |
| | Polyester/cotton | 18.4 | 180 | " |
| B | Cotton | 4.0 | 0 | White |
| | Polyester/cotton | 2.0 | 0 | " |
| C | Cotton | 18.0 | 110 | " |
| | Polyester/cotton | 15.0 | 135 | " |

A: 10 parts adduct solution, 25 parts 50% polyvinylbromide, 5 parts $H_2O$ and 10 parts alcohol. The ratio of adduct to polyvinylbromide is therefore about 1:2.5.

B: 5 parts adduct solution, 20 parts brominated triallylphosphate (prepared by reacting 22 parts triallylphosphate, 51 parts bromoform and 1 part potassium persulfate). The ratio of adduct to brominated triallylphosphate is therefore about 1:8.3.

C: 10 parts adduct solution, 20 parts tris(2,3-dibromopropyl)phosphate, 10 parts $H_2O$. The ratio of adduct to tris(2,3-dibromopropyl) phosphate is therefore about 1:4.

Example 2

Twill fabrics were padded with solutions containing both a THP-Cyanamide (2:1) adduct solution prepared by heating on a steam cone for 10 minutes a mixture comprising of 62 parts THP, 21 parts 50% Cyanamide and 90 parts $H_2O$ and various brominated compounds. The fabrics were dried at 85° C for 3 minutes and cured at 155° C for 3 minutes. All of the treated fabrics exhibited good hand and strength and formed a black carbonaceous char when exposed to flame, indicating the presence of phosphorus.

| Solution Used | Type Fabric | % Add-on | Match Test Angle | Color |
|---|---|---|---|---|
| A | Cotton | 14.5 | 110 | Sl. Brown |
| | Polyester/cotton | 14.0 | 90 | " |
| B | Cotton | 7.0 | 45 | White |
| | Polyester/cotton | 5.0 | 30 | " |
| C | Cotton | 15.6 | 145 | " |
| | Polyester/cotton | 18.1 | 135 | " |

A: 10 parts adduct solution, 20 parts 50% polyvinylbromide, 10 parts alcohol. The ratio of adduct to polyvinylbromide is therefore about 1:2.

B: 5 parts adduct solution, 20 parts brominated triallylphosphate (prepared by reacting 22 parts triallylphosphate, 51 parts bromoform and 1 part potassium persulfate). The ratio of adduct to brominated triallylphosphate is therefore about 1:8.

C: 10 parts adduct solution, 20 parts tris(2,3-dibromopropyl)phosphate, 10 parts $H_2O$. The ratio of adduct to tris(2,3-dibromopropyl)phosphate is therefore about 1:4.

Example 3

Twill fabrics were padded with solutions containing both a THP-Urea (2:1) adduct solution prepared by allowing a mixture of 62 parts THP, 30 parts urea and 90 parts $H_2O$ to stand at room temperature for 4 hours and various brominated compounds. The fabrics were dried at 85° C for 3 minutes and cured at 155° C for 3 minutes. All of the treated fabrics exhibited good hand and strength and formed black carbonaceous char when exposed to flame, indicating the presence of phosphorus.

| Solution Used | Type Fabric | % Add-on | Match Test Angle | Color |
|---|---|---|---|---|
| A | Cotton | 18.1 | 120 | Sl. Brown |
| | Polyester/cotton | 17.6 | 110 | " |
| B | Cotton | 8.0 | 0 | Sl. Yellow |
| | Polyester/cotton | 8.0 | 0 | " |
| C | Cotton | 16.0 | 110 | White |
| | Polyester/cotton | 14.0 | 135 | " |
| D | Cotton | 19.0 | 180 | " |
| | Polyester/cotton | 24.0 | 135 | " |
| E | Cotton | 28.0 | 180 | " |
| | Polyester/cotton | 28.0 | 180 | " |

A: 10 parts adduct solution, 20 parts 50% polyvinylbromide, 10 parts alcohol. The ratio of adduct to polyvinylbromide is therefore about 1:2.

B: 5 parts adduct solution, 20 parts brominated triallylphosphate (prepared by reacting 22 parts triallylphosphate, 51 parts bromoform and 1 part potassium persulfate). The ratio of adduct to brominated triallyphosphate is therefore about 1:8.

C: 10 parts adduct solution, 20 parts tris 2,3(dibromopropyl)phosphate, 10 parts $H_2O$. The ratio of adduct to tris 2,3(dibromopropyl)phosphate is therefore about 1:4.

D: 30 parts adduct solution, 10 parts brominated melamine (prepared by dissolving in 20 parts 37% formaldehyde the product obtained by slowly adding 16 parts bromine to 10.3 parts diallylmelamine dissolved in acetic acid. The ratio of adduct to brominated melamine is therefore about 1:0.6.

E: 30 parts adduct solution, 10 parts brominated acrylamide (prepared by heating for 1 hour at 80° C 7.1 parts acrylamide, 15.2 parts bromoform and 0.6 parts potassium persulfate). The ratio of adduct to brominated acrylamide is therefore about 1:0.6.

EXAMPLE 4

Cotton or Polyester/cotton twill fabric was treated with a mixture containing 5 parts THP, 5 parts trimethylolmelamine, 61 parts brominated triallylphosphate (prepared as in example 3) and 15 parts $H_2O$. The fabrics were dried at 85° C for 3 minutes and cured at 160° C for 3 minutes. The cotton sample had 19.7% add-on, poor strength and a metal test angle of 90° while the Polyester/cotton sample had 6% add-on, good strength and a match test angle of 45°.

EXAMPLE 5

10 parts of a THP-Cyanamide adduct, prepared by allowing to stand 1 hour a solution containing 62 parts THP, 42 parts 50% cyanamide and 90 parts water, and 25 parts polyvinylbromide. 5 parts $H_2O$ and 10 parts alcohol were heated in an oven at 150° C for 1 hour. The resultant product was a black hard polymer which resisted burning when exposed to flame. The polymer was insoluble in alcohol and $H_2O$.

EXAMPLE 6

A THP-Cyanamide adduct was produced by heating on a steam cone for 10 minutes a solution containing 62 parts THP, 21 parts 50% Cyanamide and 90 parts $H_2O$. 10 parts of this adduct was mixed with 20 parts of tris(2,3 dibromopropylphosphate) and 10 parts $H_2O$. The mixture was heated 1 hour at 155° C to form a yellow rubber like polymer which resisted burning when exposed to flame and formed a black char. The polymer is insoluble in alcohol, and at most, very slightly soluble in $H_2O$.

EXAMPLE 7

A THP-Urea adduct was produced by allowing to stand at room temperature for 4 hours a solution containing 62 parts THP, 30 parts urea and 90 parts $H_2O$. 30 parts of this adduct was mixed with 10 parts of a brominated melamine compound prepared by dissolving in 20 parts of 37% formaldehyde the product obtained by slowly adding 16 parts bromine to 10.3 parts diallylmelamine dissolved in 50 parts acetic acid. The mixture was heated at 155° C for 1 hour. The mixture formed yellow glass like, hard substance which resisted burning when exposed to flame and formed a black ash. The polymer was insoluble in water and alcohol.

EXAMPLE 8

30 parts of the adduct in example 7 was mixed with a brominated acrylamide prepared by heating for 1 hour at 80° C, 7.1 parts acrylamide, 15.2 parts bromoform and 0.6 parts potassium persulfate. The mixture was heated at 155° C for 1 hour to give a yellow rubber like polymer which resisted burning when exposed to flame and formed a black ash. The polymer was insoluble in water and alcohol.

EXAMPLE 9

5 parts of the same adduct in example 7 was mixed with 20 parts of brominated triallylphosphate prepared by reacting 22 parts triallylphosphate, 51 parts bromoform and 1 part potassium persulfate. The mixture was heated at 155° C for 1 hour to give a yellow hard material which resisted burning when exposed to flame and formed a black ash. The polymer was insoluble in water and alcohol.

EXAMPLE 10

5 parts THP, 5 parts trimethylolmelamine, 61 parts of brominated triallylphosphate prepared as in example 9. The mixture was heated at 155° C for 1 hour to give yellow rubbery material which resisted burning when exposed to flame and formed a black ash. The polymer was insoluble in water and alcohol.

We claim:

1. A process for preparing a flame retardant chemical formulation comprising mixing, at room temperature, in aqueous-ethanol solvent, a quantity of tris(hydroxymethyl)phosphine cyanamide 2:1 adduct with sufficient quantity of an organic bromine-containing compound selected from the group consisting of polyvinyl bromide, brominated triallyl phosphate, and tris(2,3-dibromopropyl)phosphate to yield a solution containing an adduct to brominated substance ratio of about 1 part by weight to 8 parts by weight.

2. The process of claim 1 wherein the bromine-containing compound is polyvinyl bromide.

3. The process of claim 1 wherein the bromine-containing compound is brominated triallyl phosphate.

4. The process of claim 1 wherein the bromine-containing compound is tris(2,3-dibromopropyl)phosphate.

5. The chemical formulation produced by the process of claim 2.

6. The chemical formulation produced by the process of claim 3.

7. The chemical formulation produced by the process of claim 4.

* * * * *